US008338065B2

(12) United States Patent
Katayama et al.

(10) Patent No.: US 8,338,065 B2
(45) Date of Patent: Dec. 25, 2012

(54) ELECTROPHOTOGRAPHIC PHOTORECEPTOR AND IMAGE FORMING APPARATUS PROVIDED WITH THE SAME

(75) Inventors: Satoshi Katayama, Osaka (JP); Koichi Toriyama, Osaka (JP); Hiroshi Sugimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 201 days.

(21) Appl. No.: 12/897,544

(22) Filed: Oct. 4, 2010

(65) Prior Publication Data

US 2011/0085823 A1 Apr. 14, 2011

(30) Foreign Application Priority Data

Oct. 2, 2009 (JP) ..... 2009-230556

(51) Int. Cl.
*G03G 5/00* (2006.01)

(52) U.S. Cl. ..... 430/61; 430/60; 430/58.05

(58) Field of Classification Search ..... 430/61, 430/60, 58.05; 399/159
See application file for complete search history.

(56) References Cited

U.S. PATENT DOCUMENTS

| | | | | |
|---|---|---|---|---|
| 4,518,669 | A | 5/1985 | Yashiki | |
| 5,972,550 | A * | 10/1999 | Tamura et al. | 430/65 |
| 6,824,938 | B2 * | 11/2004 | Kizaki et al. | 430/60 |

FOREIGN PATENT DOCUMENTS

| | | |
|---|---|---|
| JP | 4-172362 | 6/1992 |
| JP | 4-229872 | 8/1992 |
| JP | 2841720 | 10/1998 |
| JP | 2852432 | 11/1998 |
| JP | 2003-287914 | 10/2003 |
| JP | 2006/208474 | 8/2006 |

* cited by examiner

*Primary Examiner* — Mark A Chapman
(74) *Attorney, Agent, or Firm* — Nixon & Vanderhye P.C.

(57) ABSTRACT

An electrophotographic photoreceptor comprising: a conductive support, a photosensitive layer and an intermediate layer interposed between the conductive support and the photosensitive layer, wherein the intermediate layer contains metal oxide microparticles surface-treated with silicon dioxide anhydride and a binder resin; and the binder resin contains a polyamide resin containing a piperazine-based compound.

11 Claims, 2 Drawing Sheets

ELECTROPHOTOGRAPHIC PHOTORECEPTOR AND IMAGE FORMING APPARATUS PROVIDED WITH THE SAME

CROSS-REFERENCE TO RELATED APPLICATION

This application is related to Japanese Patent Application No. 2009-230556 filed on 2 Oct. 2009, whose priority is claimed under 35 USC §119, and the disclosure of which is incorporated by reference in its entirety.

BACKGROUND OF THE INVENTION

1. Field of the Invention

The present invention relates to an electrophotographic photoreceptor (hereinafter also referred to as a "photoreceptor" which is provided with an intermediate layer containing a polyamide resin having a specified structure and metal oxide microparticles, is reduced in the variation in sensitivity in a low-temperature and low-humidity condition and can attain good image characteristics even after being used repeatedly, and to an image forming apparatus provided with the photoreceptor.

More specifically, the present invention relates to an electrophotographic photoreceptor in which the intermediate layer contains a polyamide resin which is a condensate of a piperazine-based compound and an aliphatic di- or tri-carboxylic acid compound or a lower alkyl ester thereof or a mixture of these and metal oxide microparticles surface-treated with silicon dioxide anhydride, and also to an image forming apparatus provided with the photoreceptor.

2. Description of the Related Art

An electrophotographic system image forming apparatus (also referred to as an "electrophotographic apparatus") utilizing electrophotographic techniques to form an image is used frequently for copying machines, printers, facsimile machines, and the like.

The photoreceptor used in an electrophotographic process is constituted by laminating a photosensitive layer containing a photoconductive material on a conductive support.

Although photoreceptors (referred to also as an "inorganic photoreceptor") provided with a photosensitive layer containing an inorganic photoconductive material as its major component have been widely used so far, they have a drawback in any of heat resistance, storage stability, toxicities to human bodies and environments, sensitivity, durability, occurrence of image defects, productivity, production costs, and the like and no photoreceptor which satisfies all of these characteristics has been obtained.

Meanwhile, studies and development are now in progress concerning a photoreceptor (referred to also as an "organic photoreceptor") provided with a photosensitive layer containing an organic photoconductive material as its major component and the organic photoreceptor is predominantly used in photoreceptor applications at present.

The organic photoreceptors have more advantages than inorganic photoreceptors in terms of toxicity, production cost and the degree of freedom of material design though they have some problems in terms of sensitivity, durability and environmental stability. For example, in the organic photoreceptor, the photosensitive layer can be formed by an easy and economical method typified by an dip coating method.

Examples proposed as the structure of the organic photoreceptor include a structure in which a monolayer type photosensitive layer obtained by dispersing a charge generating material and a charge transport material (also called a "charge transfer material") in a binder resin (also called a "binding agent resin") is laminated on a conductive support and a structure in which a laminate type photosensitive layer or a reverse laminate type photosensitive layer obtained by laminating a charge generating layer produced by dispersing a charge generating material in a binder resin and a charge transport layer produced by dispersing a charge transport material in a binder resin in this order or a reverse order on a conductive support.

Among these materials, a functional separation type photoreceptor provided with the laminate type photosensitive layer or the reverse laminate type photosensitive layer is widely put to practical use because it is excellent in electrophotographic characteristics and durability and has a high degree of freedom of material selection, allowing the characteristics of photoreceptors to be variously designed.

When a photosensitive layer is directly formed on a conductive support by application in the production of an organic photoreceptor, the photosensitive layer is easily affected by the surface of the conductive support and it is therefore difficult to form a uniform film having a uniform thickness. Therefore, there is a problem that the film thickness becomes uneven, causing various image defects and uneven densities.

In the organic photoreceptor provided with a photosensitive layer having a laminate structure, the conductive support is in direct contact with the charge generating layer. Therefore, when an electric field is applied by electrification, charges generate at a part of the charge generating material and the potential is locally dropped at a place near the charge generating material, giving rise to a problem of the generation of fogging on white paper or gray parts in reverse developing. This problem is particularly significant in a high-temperature and high-humidity environment.

As measures taken to deal with the aforementioned problems, it is conventionally known that it is effective to form a resin layer called an intermediate layer (also called an "undercoat layer") between the conductive support and the photosensitive layer. For example, as the intermediate layer, a layer obtained by applying an alcohol-soluble polyimide resin to the support, followed by drying is proposed.

However, even if such an intermediate layer is formed, since these alcohol-soluble resins are largely varied in resistance according to circumstances such as temperature and humidity, there is a problem that the potential is largely changed with environmental variation, and also that there are image defects such as generation of black dots and memories and uneven densities, though good electric characteristics and image quality are obtained in a usual environment.

As the intermediate layer, there are proposed an intermediate layer containing titanium oxide microparticles coated with alumina (Japanese Unexamined Patent Publication No. 59-93453), an intermediate layer containing metal oxide particles surface-treated with a titanate-based coupling agent (Japanese Unexamined Patent Publication No. 4-172362) and, an intermediate layer containing metal oxide particles surface-treated with a silane compound (Japanese Unexamined Patent Publication No. 4-229872).

Also, a photoreceptor using a polyamide resin having a specified structure (Japanese Patent No. 2852432) and a photoreceptor using a polyamide resin having a small water absorption coefficient (Japanese Unexamined Patent Publication No. 2003-287914 and Japanese Patent No. 2841720) have been recently proposed.

However, the polyamide resin used for the intermediate layer has drawbacks that it is hardly soluble in a solvent, tends to cause uneven coating, deteriorates the dispersibility of titanium oxide, easily causing the solution to be clouded, and is increased in the accumulation amount of residual potential in a high-temperature and high-humidity condition, though it is affected little by the influence of environmental variations and has a small water absorption coefficient.

Therefore, the aforementioned proposals in the conventional techniques are insufficient as to the characteristics of the electrophotographic photoreceptor and it is desired to develop an electrophotographic photoreceptor having more excellent characteristics.

Therefore, it is an object of the present invention to provide a photoreceptor which is reduced in the variation in sensitivity in a low-temperature and low-humidity environment and can attain good image characteristics even after being used repeatedly, and an image forming apparatus provided with the photoreceptor.

SUMMARY OF THE INVENTION

The inventors of the present invention have made earnest studies to solve the aforementioned problems, and as a result, found that when the intermediate layer contains metal oxide particles, particularly, titanium oxide microparticles, which are surface-treated with silicon dioxide anhydride, and a polyamide resin containing at least a piperazine-based compound, the electrification characteristics of the photoreceptor and the humidity dependency of the sensitivity characteristics can be improved, and occurrence of fogging and generation of image defects such as black dots can be prevented, thereby completed the present invention.

According to the present invention, there is provided an electrophotographic photoreceptor comprising: a conductive support, a photosensitive layer and an intermediate layer interposed between the conductive support and the photosensitive layer, wherein the intermediate layer contains metal oxide microparticles surface-treated with silicon dioxide anhydride and a binder resin; and the binder resin contains a polyamide resin containing a piperazine-based compound.

According to the present invention, there is provided an image forming apparatus provided with the aforementioned electrophotographic photoreceptor, a charge means that electrifies the electrophotographic photoreceptor, an exposure means that forms an electrostatic latent image by exposing the charged electrophotographic photoreceptor to light, a developing means that develops the electrostatic latent image formed, by the exposure to visualize the image and a transfer means that transfers the image visualized by the developing, to a recording medium.

According to the present invention, the intermediate layer of the photoreceptor contains a polyamide resin obtained by the condensation of a piperazine-based compound and an aliphatic di- or tri-carboxylic acid compound or a lower-alkyl ester thereof or a mixture of these, thereby making it possible to provide a photoreceptor which is reduced in the variation in sensitivity even in a low-temperature/low-humidity condition and in a high-temperature/high-humidity condition and can attain good image characteristics even after being used repeatedly, and also to provide an image forming apparatus provided with the photoreceptor.

A coating solution, which is used when the intermediate layer of the photoreceptor of the present invention is formed by application, can keep a desired dispersed state for a long period of time and can form a coating film free from uneven coating even after the coating film is stored for a long period of time.

DETAILED DESCRIPTION OF THE PREFERRED EMBODIMENTS

Figure 1:
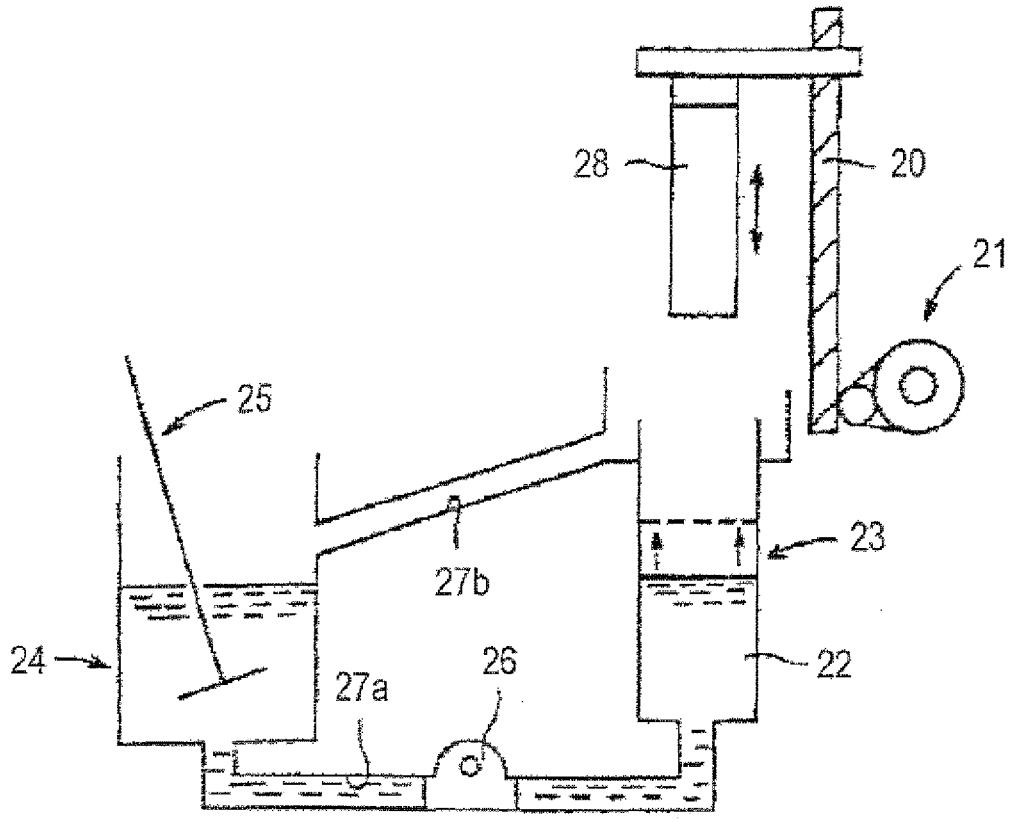
FIG. 1 is a drawing showing a dip coating equipment.

The present invention also provides the electrophotographic photoreceptor wherein the binder resin contains a condensate of the piperazine-based compound and a linear aliphatic dicarboxylic acid, or a branched di- or tri-carboxylic acid produced as the aliphatic di- or tri-carboxylic acid by a bimolecular or termolecular addition reaction to unsaturated bonds of one or a mixture of two kinds of monounsaturated fatty acids and diunsaturated fatty acids or esters thereof.

The present invention also provides the electrophotographic photoreceptor wherein the binder resin contains a condensate of piperazine and oleic acid, linoleic acid, or lower alkyl esters thereof or bimolecular or termolecular addition reaction products to unsaturated bonds of mixtures of these.

The present invention also provides the electrophotographic photoreceptor wherein the binder resin is a condensate of (a) a piperazine-based compound and (b) the aliphatic di- or tri-carboxylic acid compound or a lower alkyl ester thereof or a mixture of these in which the equivalent ratio of (a):(b)=1.0 to 2.0:0.5 to 1.0.

The present invention also provides the electrophotographic photoreceptor wherein the binder resin contains a polyamide resin having a number average molecular weight of 5,000 to 80,000.

The present invention also provides the electrophotographic photoreceptor wherein the metal oxide microparticles are titanium oxide microparticles and the titanium oxide microparticles have a number average primary particle diameter of 30 to 50 nm.

The present invention also provides the electrophotographic photoreceptor wherein the metal oxide microparticles are contained in a ratio of 50 to 1000 parts by weight based on 100 parts by weight of the polyamide resin.

The present invention also provides the electrophotographic photoreceptor wherein the photosensitive layer is a laminate type photosensitive layer formed of a charge generating layer containing at least a charge generating material and a charge transport layer containing a charge transport material.

The electrophotographic photoreceptor according to the present invention features that the aforementioned piperazine-based compound is represented by the following chemical structural formula:

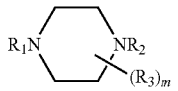

wherein $R_1$ and $R_2$ each independently represent a hydrogen atom or a group $—(CH_2)_nNH_2$ (here, n represents an integer from 0 to 10), $R_3$ represents a lower alkyl or oxo group and m represents an integer from 0 to 2.

The lower alkyl group is a methyl, ethyl, n-propyl, isopropyl, n-butyl, isobutyl or t-butyl group.

Specific examples of the piperazine-based compound include piperazine, 2,5-dimethylpiperazine, 2,5-diethylpiperazine, 2,5-di-n-propylpiperazine, 2,5-di-isopropylpiperazine, 2,5-di-n-butylpiperazine, 2,5-di-t-butylpiperazine, 2,5-piperazinedione, N,N'-di(aminomethyl)piperazine, N,N'-di(aminoethyl)piperazine, N,N'-di(aminopropyl)piperazine, N,N'-di(aminobutyl)piperazine, N,N'-di(aminopentyl)piperazine, N,N'-di(aminohexyl)piperazine, N,N'-di(aminoheptyl)piperazine, N,N'-di(aminooctyl)piperazine, N,N'-di(aminononyl)piperazine and N,N'-di(aminodecanyl)piperazine.

The electrophotographic photoreceptor may contain a diamine component, for example, cyclohexylene diamines such as 1,2-diaminocyclohexane, 1,3-diaminocyclohexane, 1,4-diaminocyclohexane, 2'-aminomethylcyclohexylmethylamine, 3'-aminomethylcyclohexylmethylamine, 4'-aminomethylcyclohexylmethylamine, 2'-aminoethylcyclohexylethylamine, 3'-aminoethylcyclohexylethylamine, 4'-aminoethylcyclohexylethylamine, 2'-aminopropylcyclohexylpropylamine, 3'-aminopropylcyclohexylpropylamine, 4'-aminopropylcyclohexylpropylamine and bicyclohexanediamine besides the diamine having a piperazine ring structure.

At least a specified polyamide resin obtained by polymerizing a piperazine-based compound with an aliphatic di- or tri-carboxylic acid compound, or an alkyl ester thereof or a mixture of these is contained as the binder resin in the intermediate layer of the electrophotographic photoreceptor according to the present invention.

The term "aliphatic" used in the present invention means a hydrocarbon compound having 2 or more carbon atoms. It is preferable to use a higher aliphatic compound having 10 or more carbon atoms.

The term "lower alkyl ester" used in the present invention means an ester of the aforementioned aliphatic di- or tri-carboxylic acid and an alcohol having 1 to 4 carbon atoms.

More specifically, the term "lower alkyl ester" used in the present invention means a methyl, ethyl, n-propyl, isopropyl, n-butyl, isobutyl or t-butyl ester.

As to the term "saturated aliphatic di- or tri-carboxylic acid" used in the present invention, examples of the di-carboxylic acid include linear dicarboxylic acids having 2 to 22 carbon atoms and specifically, oxalic acid, malonic acid, succinic acid (anhydride), maleic acid (anhydride), glutaric acid, adipic acid, pimelic acid, suberic acid, azelaic acid, sebacic acid, 1,18-octadecanedicarboxylic acid and 1,16-hexadecanedicarboxylic acid.

Examples of the aforementioned "saturated aliphatic di- or tri-carboxylic acid" include branched dicarboxylic acids or tricarboxylic acids or hydrogenated products of these acids which are bimolecular or termolecular adducts between the same molecules or different molecules which are obtained by an addition reaction to the unsaturated bonds of a single compound or a mixture of two kinds of substances selected from aliphatic monounsaturated fatty acids having an unsaturated bond at one position such as decenoic acid, undecenoic acid, dodecenoic acid, tridecenoic acid, tetradecenoic acid, pentadecenoic acid, hexadecenoic acid, heptadecenoic acid, octadecenoic acid (oleic acid), nonadecenoic acid and eicosenoic acid; and/or diunsaturated fatty acids having unsaturated bonds at two positions such as decadienoic acid, undecadienoic acid, dodecadienoic acid, tridecadienoic acid, tetradecadienoic acid, pentadecadienoic acid, hexadecadienoic acid, heptadecadienoic acid, octadecadienoic acid (linoleic acid), nonadecadienoic acid, eicosadienoic acid and docosadienoic acid, or esters of these.

Among these, preferable are branched dicarboxylic acids or tricarboxylic acids or hydrogenated products of these acids which are bimolecular or termolecular adducts between the same molecules or different molecules which are obtained by an addition reaction to the unsaturated bonds of substances selected from oleic acid which is a monounsaturated fatty acid, linoleic acid which is a diunsaturated fatty acid, or a mixture of these acids or lower alkyl esters of these acids.

Examples of commercially available products of the dicarboxylic acid include HARIDIMER 200, 250, 270S and 300 (manufactured by Harima Chemicals, Inc.), and EMPOL 1022 (manufactured by Cognis Corporation).

Moreover, a hydrogenated dicarboxylic acid may also be used. Examples of commercially available products of the hydrogenated dicarboxylic acid include PRIPOL 1009 (manufactured by Croda).

The aforementioned aliphatic di- or tri-carboxylic acid or lower alkyl esters of these carboxylic acids may be generally produced by an addition reaction to unsaturated bonds by using the aforementioned unsaturated fatty acids or esters thereof. Examples of a catalyst for the addition reaction include liquid or solid Lewis acids, Brønsted acid, and activated white earth such as montmorillonite, bentonite, hectorite or halloysite.

When the aforementioned aliphatic di- or tri-carboxylic acid or lower alkyl esters thereof have unsaturated bonds, they can be produced by hydrogenation. The aforementioned aliphatic tricarboxylic acid effectively acting on an improvement in the flexibility of a resin may be mixed with an aliphatic dicarboxylic acid.

The aforementioned aliphatic di- or tri-carboxylic acid or lower alkyl esters of these may be combined with other higher saturated fatty acid lower alkyl esters added in an appropriate amount.

Specifically, a methyl, ethyl, isopropyl or t-butyl ester of decanoic acid, hendecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid or the like may be used in combination.

The polyamide resin to be used for the intermediate layer in the present invention is obtained by allowing the aforementioned piperazine-based compound to undergo a condensation reaction with the aforementioned aliphatic di- or tri-carboxylic acid or an alkyl ester thereof or a mixture of these.

Piperazine is preferable as the piperazine-based compound from the viewpoint of cost reduction though 2,5-dimethylpiperazine and 2,5-piperazinedione may also be used.

Besides the diamine derivative having a piperazine ring structure, ethylenediamine, diaminopropane, diaminobutane, diaminopentane, hexamethylenediamine, octanediamine, nonanediamine, decanediamine, lauryldiamine, xylenediamine, phenylenediamine, toluoylenediamine, diaminodiphenylmethane, diaminodiphenyl ether, diaminobenzophenone, 1,3-bis(4-aminiphenoxy)benzene, and the like may be used singly or in combinations of two or more.

As the aliphatic aminocarboxylic acid, 6-aminocaproic acid, 11-aminoundecanoic acid, 12-aminododecanoic acid, and the like may be used singly or in combinations of two or more.

The polyamide resin used in the present invention can be obtained by, for example, the polyamide synthesis method described in Japanese Examined Patent Publication No. 55-38380.

No particular limitation is imposed on the method of producing the polyamide resin and, for example, a usual polyamide polycondensation method, melt polymerization method, solution polymerization method or interfacial polymerization method may be properly applied.

A monobasic acid such as acetic acid or benzoic acid or a monoacidic base such as hexylamine or aniline may be used as a molecular regulating agent in the polymerization.

This condensation polymerization reaction is carried out by a usual method. That is, it is preferable to carry out the reaction by mixing the aforementioned aliphatic di- or tri-carboxylic acid or an alkyl ester thereof with the diamine derivative having a piperazine ring structure in an equivalent amount or at an adequate ratio to prepare a solution, which is then heated to polymerize while water and alcohol are removed.

The reaction is carried out in the following condition: the reaction temperature is 100 to 300° C., preferably 120 to 230° C. and more preferably 130 to 200° C.

The reaction time is usually within 10 hours though it cannot be determined because the reaction is continued until the condensation polymerization is finished.

In order to carry out this condensation polymerization reaction, the aforementioned aliphatic di- or tri-carboxylic acid or an alkyl ester thereof is mixed with the diamine derivative having a piperazine ring structure in an equivalent amount or at an adequate ratio prior to heating. At this time, the reaction raw materials are preferably dissolved and mixed in methanol, ethanol, isopropanol, water, or the like.

The pressure of the solution may be reduced and an inert gas may be introduced before heating to keep the solution in an inert gas atmosphere.

The dehydration or dealcoholization reaction by heating may be carried out under reduced pressure or under a pressurized condition though it is usually carried out under normal pressure with introducing a small amount of an inert gas.

The reaction solution is gradually thickened with the progress of the condensation polymerization reaction as mentioned above and it is therefore preferable to keep the solution at a temperature higher than the dissolution temperature of the condensation polymerization product.

The binder resin used in the intermediate layer of the photoreceptor of the present invention is a polyamide resin which is a condensate of a diamine derivative having at least a piperazine ring structure and at least an aliphatic di- or tri-carboxylic acid or an alkyl ester thereof or a mixture of these. In this case, the polyamide resin may contain, as other structural units, ϵ-caprolactam, 4,4'-diamino-dicyclohexylmethane, 1,6-hexamethylenediamine, adipic acid, and the like, provided that the ratio of these other structural units is preferably 50% by mol or less.

Moreover, the binder resin used for the intermediate layer of the photoreceptor of the present invention may contain aromatic dicarboxylic acids such as terephthalic acid, isophthalic acid, phthalic acid and naphthalenedicarboxylic acid, cyclic dicarboxylic acids such as 1,3- or 1,4-cyclohexanedicarboxylic acid, and aliphatic aminocarboxylic acids such as 6-aminocaproic acid, 11-aminoundecanoic acid and 12-aminododecanoic acid.

Specific examples of commercially available polyamide resins containing a piperazine-based compound include M1276 (manufactured by ARKEMA).

The number average molecular weight of the polyamide resin of the present invention is preferably 5,000 to 80,000 and more preferably 10,000 to 60,000.

When the number average molecular weight of the polyamide resin is less than 5,000, the intermediate layer is deteriorated in the uniformity of film thickness and the effect of the present invention is not sufficiently produced. When the number average molecular weight of the polyamide resin exceeds 80,000, the solubility of the resin in a solvent is easily deteriorated, so that the aggregation of the resin tends to occur in the intermediate layer, causing easy development of image defects such as black dots.

The number average molecular weight in the present invention is measured in the following manner. Using a GPC device (trade name: HLC-8220GPC, manufactured by Tosoh Corporation), a molecular weight distribution curve is found with a sample solution consisting of a hexafluoroisopropanol solution containing 0.25% by weight of the sample and by setting the amount of the sample solution to be injected as 100 mL. The molecular weight at the peak top of the obtained molecular weight distribution curve is found as a peak top molecular weight. The number average molecular weight Mn is found from the molecular weight distribution curve. The calibration curve of molecular weight is made using standard polystyrene.

The intermediate layer of the photosensitive layer of the present invention contains titanium oxide microparticles as the metal oxide microparticles surface-treated with silicon dioxide anhydride. If titanium oxide microparticles which are not surface-treated are used, the titanium oxide microparticles are inevitably aggregated when the photoreceptor is used for a long time or the coating solution is stored even if the coating solution is an undercoat layer coating solution in which these microparticles are sufficiently dispersed, because the titanium oxide particles are fine. For this reason, when the undercoat layer is formed, defects and coating unevenness of the coating film arise, causing image defects. Because the injection of charges from the conductive support easily occurs, deterioration in electrification ability in micro-regions is brought about, with the result of the generation of black dots.

Attempts have been conventionally generally made to improve the dispersibility of the microparticles in the undercoat layer by carrying out surface treatment using alumina. However, in the case of forming the undercoat layer on a drum in the dip coating step, it is necessary to produce a large amount of the coating solution. At this time, when dispersing treatment is carried out for a long time, black dots generate by the reaggregation of titanium oxide microparticles, giving rise to a problem concerning deteriorated image quality. A reason for this problem is inferred to be that alumina used for the surface treatment is peeled off by long-term dispersing treatment, so that the effect of the surface treatment for titanium oxide is lessened, leading to the reaggregation of titanium oxide which is a cause of image defects, and also, charges are easily injected from the conductive support, bringing about deteriorated charging ability in micro-regions of the undercoat layer, resulting in the occurrence of black dots.

Moreover, such black dots become conspicuous when a photoreceptor is used for a long time in a high-temperature and high-humidity environment and the image quality is significantly deteriorated.

On the other hand, there is a case where silicon dioxide is used in combination with alumina to carry out the surface treatment for titanium oxide sufficiently. However, if the surface treatment is carried out by using silicon dioxide in combination with alumina, crystal water is contained resultantly. It is estimated that the undercoat layer is easily affected by the moisture in various environments due to the crystal water, with the result that not only the image quality is deteriorated but also the sensitivity of the photoreceptor is also adversely affected.

Besides, when the surface of titanium oxide microparticles is coated with a metal oxide having magnetism such as $Fe_2O_3$, a chemical interaction with a phthalocyanine pigment contained in the photosensitive layer is caused, and therefore, deterioration in the characteristics of the photoreceptor, particularly, a reduction in sensitivity and charging ability arises, which is undesirable.

According to the present invention, the electrophotographic photoreceptor, which is reduced in the influence of moisture, and is excellent in the formation of images free from black dots and image fogging and in stability in repeated use in various environments, is obtained by coating the surface of titanium oxide microparticles with silicon dioxide anhydride. When the titanium oxide microparticles are coated with silicon dioxide anhydride, an electrophotographic photoreceptor is obtained which ensures that the aggregation of titanium oxide is prevented even after the long-term dispersing treatment, to give a stable coating solution, ensuring that a very uniform undercoat layer coating film can be formed.

Moreover, an electrophotographic photoreceptor which has excellent image characteristics and is free from black dots is obtained since the injection of charges from the conductive support can be prevented. Also, the effects of the polyimide resin having a piperazine ring structure and titanium oxide microparticles coated with silicon dioxide anhydride give the advantages that a change in potential caused by environmental variation is reduced, and excellent electric characteristics such as the stable sensitivity of the photoreceptor and excellent image characteristics free from black dots and image fogging are obtained even if the photoreceptor is used repeatedly in a low-temperature and low-humidity environment or in a high-temperature and high-humidity environment.

The amount of silicon dioxide anhydride used to coat the surface of the titanium oxide microparticles is preferably 0.1% by weight to 50% by weight based on titanium oxide. When the amount of silicon dioxide anhydride is less than 0.1% by weight, the surface of titanium oxide microparticles can not be sufficiently coated and it is therefore difficult to develop the effect of the surface treatment. When the amount exceeds 50% by weight, the effect obtained by adding titanium oxide microparticles is reduced and also, there is substantially no material which takes the place of silicon dioxide microparticles, and therefore, the sensitivity of the photoreceptor is deteriorated, causing image fogging, which is undesirable.

Examples of the crystal type of titanium oxide microparticles include an anatase type, a rutile type and an amorphous type. In the present invention, the crystal type of titanium oxide microparticles may be any of the aforementioned types and may be a mixture of two or more types.

Examples of the shape of titanium oxide microparticles include a dendritic form, a needle form and a granular form and the titanium oxide microparticles in the present invention may take any of the aforementioned forms.

The number average primary particle diameter of the titanium oxide microparticles is preferably 30 to 50 nm.

When the number average primary particle diameter of the titanium oxide microparticles is less than 30 nm, the efficiency of dispersion of the titanium oxide microparticles is deteriorated, leading to easy generation of fine black dots in an image. Also when the number average primary particle diameter of the titanium oxide microparticles exceeds 50 nm, the dispersibility of the titanium oxide microparticles is deteriorated and there is therefore a case where the initial sensitivity is easily deteriorated under a low-temperature and low-humidity environment.

Examples of commercially available products of the titanium oxide microparticles include TS-043 (trade name, manufactured by Showa Denko K.K., average primary particle diameter: 30 nm).

The intermediate layer of the photoreceptor of the present invention primarily contains titanium oxide microparticles and a binder resin and may contain, as required, additives such as an antioxidant and a conductive agent.

The intermediate layer may be formed, for example, by dissolving or dispersing the titanium oxide microparticles of the present invention, the polyamide resin of the present invention and, as required, additives in an organic solvent to prepare an intermediate layer-forming coating solution, and by applying this coating solution to the surface of the conductive support, followed by drying to remove the organic solvent.

Specifically, the intermediate layer-forming coating solution can be prepared by dissolving the polyamide resin of the present invention in an organic solvent, and adding and dispersing the titanium oxide microparticles of the present invention in the obtained solution.

A ball mill, a sand mill, a roll mill, a paint shaker, an attritor, an ultrasonic dispersing machine, or the like may be used to disperse the titanium oxide microparticles in the solution.

The content of the titanium oxide microparticles in the intermediate layer is preferably 50 to 1000 parts by weight, more preferably 70 to 800 parts by weight and particularly preferably 100 to 500 parts by weight based on 100 parts by weight of the polyamide resin as the binder resin.

When the content of the titanium oxide microparticles in the intermediate layer is in the aforementioned range, the titanium oxide microparticles have a good balance between dispersibility and electrical insulation, making it possible to reduce the occurrence of fogging in a high-temperature and high-humidity environment.

Examples of the organic solvent include lower alcohols such as methanol, ethanol, n-propyl alcohol, isopropyl alcohol, n-butanol, 2-butanol, isobutanol and t-butanol.

Among these lower alcohols, methanol and ethanol are particularly preferable from the viewpoint of the solubility of the polyamide resin and coatability of the prepared coating solution.

In the total amount of the solvents contained in the intermediate layer-forming coating solution, the amount of the aforementioned lower alcohol solvent is preferably 30 to 100% by weight, more preferably 40 to 100% by weight and particularly preferably 50 to 100% by weight.

In the preparation of the intermediate layer-forming coating solution, toluene, methylene chloride, cyclohexanone, tetrahydrofuran and 1,3-dioxolan may be combined as an auxiliary solvent to adjust the vaporization speed of the solvent.

The amount of the auxiliary solvent is about 5 to 50% by weight based on the amount of the organic solvent.

As the method of applying the intermediate layer-forming coating solution, it is only required to properly select a most adequate method taking the physical properties of the coating solution and productivity into account. Examples of the coating method include a dip coating method, a spray method, a nozzle method, a bar coating method, a roll coating method, a blade coating method, a ring method, and an dip coating method.

Among these coating methods, the dip coating method is one in which a substrate is immersed in a coating vessel filled with a coating solution and then pulled up at a fixed speed or at a successively varied speed to thereby form a layer on the substrate. This method is relatively simple and is excellent in productivity and cost reduction, and is therefore preferably used in the production of a photoreceptor. The equipment used in the dip coating method may be provided with a coating solution dispersing machine typified by an ultrasonic wave generator in order to stabilize the dispersibility of the coating solution.

To explain the equipment used in the dip coating method in more detail with reference to the dip coating equipment shown in FIG. 1, a coating solution 22 is accommodated in a coating solution vessel 23 and a stirring vessel 24. The coating solution 22 is fed to the coating solution vessel 23 from the stirring vessel 24 through a circulating passage 27*a* by a motor 26 and fed from the coating solution vessel 23 to the stirring vessel 24 through a slanting circulating passage 27*b* which connects the upper part of the coating solution vessel 23 with the upper part of the stirring vessel 24. Thus, the coating solution is circulated in this manner.

A conductive support 28 is attached to a rotating shaft 20 on the upper part of the coating solution vessel 23. The axis of the rotating shaft 20 is extended along the vertical direction of the coating solution vessel 23. The attached support 28 rises and falls when the rotating shaft 20 is rotated by a motor 21. The motor 21 is made to rotate in a predetermined direction to make the support 28 fall to thereby immerse the support 28 in the coating solution 22 filled in the coating solution vessel 23.

Next, the motor 21 is made to rotate in a direction reverse to the aforementioned direction to make the support 28 rise to pull up the support 28 from the coating solution 22, followed by drying the support 28, thereby forming a film from the coating solution 22.

Particularly, the dip coating method shown in FIG. 1 is one in which the conductive support is immersed in the coating solution vessel filled with the photoreceptor coating solution and then pulled up at a fixed speed or at a successively varied speed to form a photosensitive layer. Because this dip coating method is relatively simple and is excellent in productivity and cost reduction, it is utilized in many cases of producing electrophotographic photoreceptors.

From the aforementioned fact, the intermediate layer of the photoreceptor of the present invention is preferably formed by a coating method using a coating solution obtained by dissolving or dispersing titanium oxide microparticles and a polyimide resin in a solvent containing a lower alcohol.

Although no particular limitation is imposed on the temperature in the step of drying the coating film insofar as it is a temperature high enough to remove the used organic solvent, the temperature is properly 50 to 140° C. and particularly preferably 80 to 130° C.

When the drying temperature is less than 50° C., there is a case where the drying time becomes longer. When the drying temperature exceeds 140° C., there is a fear that the electric characteristics of the photoreceptor in repeated use are deteriorated, resulting in a deteriorated image.

Such a temperature condition in the production of the photoreceptor is not limited only to the formation of the intermediate layer but is common to the formation of a photosensitive layer which will be explained later and to other treatments.

With regard to the film thickness of the intermediate layer, if the film thickness is too small, the effect on the prevention of local charge insufficiency is reduced whereas if the film thickness is too large, it causes a rise in residual potential and a reduction in the adhesive strength between the conductive support and the photosensitive layer. Therefore, the film thickness of the intermediate layer is preferably 0.1 to 10 μm and more preferably 0.3 to 5 μm.

Photoreceptor and Photosensitive Layer

Next, the structure of the photoreceptor of the present invention will be explained specifically.

Figure 2:
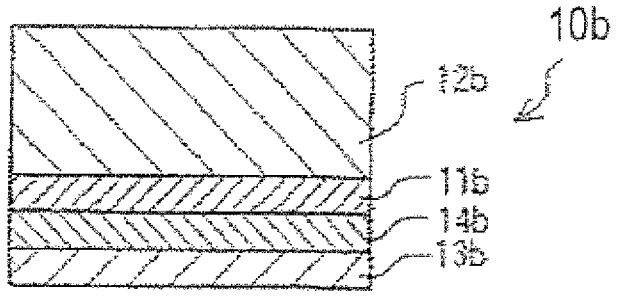
FIG. 2 is a schematic sectional view showing a structure of an essential part of an electrophotographic photoreceptor according to the present invention.
Figure 3:
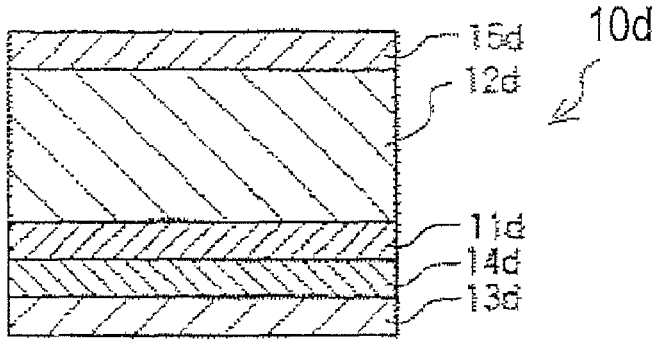
FIG. 3 is a schematic sectional view showing a structure of an essential part of an electrophotographic photoreceptor according to the present invention.

FIG. 2 and FIG. 3 are respectively a schematic sectional view showing a structure of an essential part of the photoreceptor of the present invention.

A photoreceptor 10*b* in FIG. 2 is provided with a conductive support 13*b* and an intermediate layer 14*b*, a charge generating layer 11*b* and a charge transport layer 12*b* which are formed on the conductive support 13*b* in this order.

A photoreceptor 10*d* in FIG. 3 is provided with a conductive support 13*d* and an intermediate layer 14*d*, a charge generating layer 11*d*, a charge transport layer 12*d* and a surface protective layer 15*d* which are formed on the conductive support 13*d* in this order.

The photosensitive layer of the photoreceptor of the present invention may be any of a monolayer type photosensitive layer containing a charge generating material and a charge transport material, a laminate type photosensitive layer in which at least a charge generating layer containing a charge generating material and a charge transport layer containing a charge transport material are laminated in this order and a reverse laminate type photosensitive layer in which at least a charge generating layer containing a charge generating material and a charge transport layer containing a charge transport material are laminated in a reverse order. However, as the photosensitive layer of the photoreceptor of the present invention, a laminate type photosensitive layer as shown in FIG. 2 and FIG. 3 is preferable from the viewpoint of resistance to abrasion.

Structures of the photoreceptor of the present invention except for the intermediate layer will be explained.

(Conductive Supports 13*b* and 13*d*)

No particular limitation is imposed on the constituent material of the conductive supports 13*b* and 13*d* in the photosensitive layers 10*b* and 10*d* as long as it has the functions as the electrode of a laminate type photoreceptor 1 and as the support member and is a material used in the art.

Specific examples of the constituent material include metal materials such as aluminum, aluminum alloys, copper, zinc, stainless steel and titanium; and materials obtained by laminating a metal foil, or by depositing a metal material, or by depositing or applying a layer of a conductive compound such as a conductive polymer, tin oxide or indium oxide, on the surface of a support made of a polymer material such as a polyethylene terephthalate, polyamide, polyester, polyoxymethylene or polystyrene, hard paper or glass.

Figure 4:
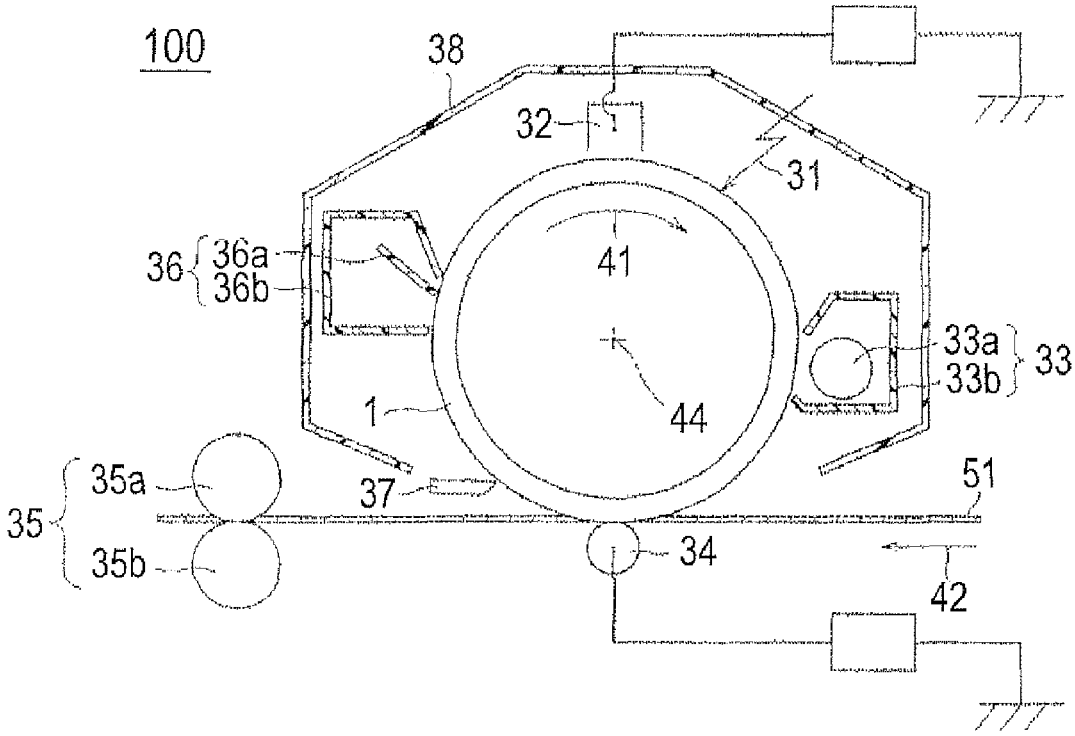
FIG. 4 is a schematic side view showing a structure of an image forming apparatus according to the present invention.

The shape of the conductive supports 13*b* and 13*d* is not limited to a cylinder form (drum form) as shown in FIG. 4, but may be a sheet form, a columnar form or an endless belt form.

Anodic oxidation coating treatment, surface treatment using chemicals or hot water, coloring treatment and irregular reflection treatment, for example, surface roughing treatment may be carried out to the surface of the conductive support as necessary to the extent that image quality is not adversely affected.

The irregular reflection treatment is particularly effective in the case of using the photoreceptor according to the present invention in the electrophotographic process using a laser as an exposure light source. Specifically, because, in the electrophotographic process using a laser as the exposure light source, the wavelengths of the laser light are uniform and therefore, the laser light reflected on the surface of the photoreceptor interferes with the laser light reflected inside of the photoreceptor. There is therefore a case where the interference fringes generated by the interference appear on an image, causing image defects. In light of this, the irregular reflection treatment is carried out to the surface of the conductive support, thereby making it possible to prevent the image defects caused by the interference of the laser light uniform in wavelengths.

(Charge Generating Layers 11*b* and 11*d*)

The charge generating layer contains a charge generating material which absorbs light such as semiconductor laser light to generate charges.

Examples of materials effective as the charge generating material include azo type pigments such as monoazo type pigments, bisazo type pigments and trisazo type pigments; indigo type pigments such as indigo and thioindigo; perylene type pigments such as peryleneimide and perylenic acid anhydride; polycyclic quinone type pigments such as anthraquinone and pyrenequinone; phthalocyanine type pigments such as metal phthalocyanine, for example, oxotitaniumphthalocyanine, and nonmetal phthalocyanine; organic photoconductive materials such as squarylium dyes, pyrylium salts, thiopyrylium salts and triphenylmethane type dyes; and inorganic photoconductive materials such as selenium and amorphous silicon. Appropriate materials sensitive to the exposure wavelength region may be selected for use from these materials. These charge generating materials may be used either singly or in combinations of two or more.

The charge generating material may be combined with sensitizing dyes such as triphenylmethane type dyes typified by Methyl Violet, Crystal Violet, Night Blue and Victoria Blue, acridine type dyes typified by Erythrocin, Rhodamine B, Rhodamine 3R, Acridine Orange and Furapeocin, thiazine dyes typified by Methylene Blue and Methylene Green, oxazine dyes typified by Capryl Blue and Meldola's Blue, cyanine dyes, styryl dyes, pyrylium salt dyes and thiopyrylium salt dyes, to improve its functions.

The ratio of the sensitizing dye is preferably 10 parts by weight or less and more preferably 0.5 to 2.0 parts by weight based on 100 parts by weight of the charge generating material, though no particular limitation is imposed on it.

The charge generating layer may contain a binder resin to improve binding ability.

As the binder resin, a resin which is used in the art and has binding ability may be used. Those having high compatibility with the charge generating material are preferable.

Specific examples of the binder resin include a polyester resin, a polystyrene resin, a polyurethane resin, a phenol resin, an alkyd resin, a melamine resin, an epoxy resin, a silicone resin, an acrylic resin, a methacrylic resin, a polycarbonate resin, a polyarylate resin, a phenoxy resin, a polyvinylbutyral resin, a polyvinylformal resin and copolymer resins having two or more of the repeating units constituting these resins. Examples of the copolymer resins include insulating resins such as a vinyl chloride/vinyl acetate copolymer resin, a vinyl chloride/vinyl acetate/maleic acid anhydride copolymer resin and an acrylonitrile/styrene copolymer resin. However, the binder resin to be used in the present invention is not limited to these resins and resins which are generally used in the art may also be used. These binder resins may be used either singly or in combinations of two or more.

The ratio of the binder resin to be used is about 0.5 to 2.0 parts by weight based on 100 parts by weight of the charge generating material, though no particular limitation is imposed on it.

The charge generating layer may contain one kind or two or more kinds selected from hole transport materials, electron transport materials, antioxidants, ultraviolet absorbers, dispersion stabilizers, sensitizers, leveling agents, plasticizers, microparticles of inorganic or organic compounds, and the like as necessary.

The charge generating layer may be formed by a known dry method or wet method.

Examples of the dry method include a method in which a charge generating material is deposited under vacuum on the surface of the intermediate layer formed on the conductive support.

Examples of the wet method include a method in which a charge generating material and, as necessary, a binder resin are dissolved or dispersed in an appropriate organic solvent to prepare a charge generating layer-forming coating solution, which is then applied to the intermediate layer formed on the conductive support, followed by drying to remove the organic solvent.

Examples of the solvent used in the charge generating layer-forming coating solution include halogenated hydrocarbons such as dichloromethane and dichloroethane; ketones such as acetone, methyl ethyl ketone and cyclohexanone; esters such as ethyl acetate and butyl acetate; ethers such as tetrahydrofuran (THF) and dioxane; alkyl ethers of ethylene glycol such as 1,2-dimethoxyethane; aromatic hydrocarbons such as benzene, toluene and xylene; aprotic polar solvents such as N,N-dimethylformamide and N,N-dimethylacetamide. Among these solvents, non-halogen organic solvents are preferably used in consideration of global environment. These solvents may be used either singly or in combinations of two or more.

The charge generating material may be milled by a milling machine before it is dissolved or dispersed in a solvent. Examples of the milling machine include a ball mill, a sand mill, an attritor, a vibration mill and an ultrasonic dispersing machine.

A dispersing machine such as a paint shaker, a ball mill or a sand mill may be used to dissolve or disperse the charge generating material in a solvent. At this time, it is desirable to design the dispersing conditions properly to prevent the occurrence of a phenomenon that impurities are generated from the members constituting the container and the dispersing machine by abrasion or the like and intermingled in the coating solution.

Other steps and conditions conform to those in the formation of the intermediate layer.

The film thickness of the charge generating layer is preferably 0.05 to 5 μm and more preferably 0.1 to 1 μm, though no particular limitation is imposed on it.

When the film thickness of the charge generating layer is less than 0.05 μm, there is a fear as to deterioration in light absorption efficiency and in the sensitivity of the photoreceptor. When the film thickness of the charge generating layer exceeds 5 μm, the transfer of charges in the charge generating layer comes into a rate-determining step of the process of removing the charges on the surface of the photosensitive layer and there is therefore a fear as to deterioration in the sensitivity of the photoreceptor.

(Charge Transport Layers 12*b* and 12*d*)

The charge transport layer has a function to transport the charges generated in the charge generating layer to the surface of the photoreceptor.

The charge transport layer contains at least a charge transport material and a binder resin.

As the charge transport material, high-molecular compounds such as polyvinylcarbazole, polyvinylpyrene and polyacenaphthylene, and low-molecular compounds such as various types of pyrazoline derivatives, oxazole derivatives, hydrazone derivatives, stilbene derivatives and arylamine derivatives may be used. Examples of the binder resin include polymers and copolymers of vinyl compounds such as styrene, vinyl acetate, vinyl chloride, acrylic acid esters, methacrylic acid esters, vinyl alcohol and ethyl vinyl ether, polyvinyl acetal, polycarbonate, polyester, polyamide, polyurethane, cellulose ether, a phenoxy resin, a silicon resin and an epoxy resin.

Among the resins which are used in the art and have binding ability, transparent resins which do not absorb light from the exposure light source of an image forming apparatus may be used as the binder resin, and the same resins as those contained in the charge generating layer may be used either singly or in combinations of two or more.

Among these resins, polystyrene, polycarbonate, polyarylate and polyphenylene oxide are preferable because they each have a volume resistance of $10^{13}\Omega$ or more, showing that they are excellent in electrical insulation, and are also excellent in film forming ability, potential characteristics, and polycarbonate is particularly preferable.

The ratio of the binder resin to be used is about 50 to 300 parts by weight based on 100 parts by weight of the charge transport material, though there is no particular limitation.

The charge transport layer may contain one kind or two or more kinds selected from hole transport materials, electron transport materials, antioxidants, ultraviolet absorbers, dispersion stabilizers, sensitizers, leveling agents, plasticizers, microparticles of inorganic or organic compounds, and the like as necessary.

The charge transport layer may be formed by preparing a charge transport layer-forming coating solution in the same manner as in the case of the charge generating layer and applying the coating solution to the intermediate layer by a wet method, particularly an dip coating method.

As the solvent to be used for preparing the charge transport layer-forming coating solution, the same solvents used in the preparation of the charge generating layer-forming coating solution may be used either singly or in combinations of two or more.

Specific examples of the solvent include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, carbon tetrachloride and chlorobenzene; ethers such as dimethyl ether, diethyl ether, tetrahydrofuran, dioxane, dioxolan, propylene glycol monomethyl ether, ethylene glycol dimethyl ether and diethylene glycol dimethyl ether; ketones such as acetone, methyl ethyl ketone and cyclohexanone; esters such as ethyl acetate and methyl acetate; dimethylformaldehyde, dimethylformamide and dimethylsulfoxide. It is preferable to use tetrahydrofuran or 1,3-dioxolan independently among these solvents.

Other steps and conditions conform to those in the formation of the intermediate layer or the charge generating layer.

The film thickness of the charge transport layer is preferably 5 to 40 μm and more preferably 10 to 30 μm, though no particular limitation is imposed on it.

When the film thickness of the charge transport layer is less than 5 μm, there is a fear as to deterioration in the charge retentive ability of the surface of the photoreceptor and hence in the contrast of the output image. When the film thickness of the charge transport layer exceeds 100 μm, there is a fear as to deterioration in productivity of the photoreceptor.

(Surface Protective Layer 15*d*)

The photoreceptor of the present invention may be provided with a surface protective layer (sometimes simply referred to as a "protective layer") on the photosensitive layer as shown in FIG. 2.

The protective layer has an ability to improve the durability of the photoreceptor, contains a binder resin and may contain one kind or two or more kinds of charge transport materials that are the same as those contained in the charge transport layer.

Examples of the binder resin include the same binders as those contained in the charge generating layer or the charge transport layer.

The surface protective layer can be formed by dissolving the binder resin in an appropriate solvent to prepare a protective layer-forming coating solution and applying this coating solution to the surface of the photosensitive layer, followed by drying to remove the organic solvent.

Other steps and conditions conform to those in the formation of the intermediate layer, the charge generating layer or the charge transport layer.

The film thickness of the protective layer is preferably 0.5 to 10 μm and more preferably 1 to 5 μm, though no particular limitation is imposed on it.

When the film thickness of the protective layer is less than 0.5 μm, there is a fear that the scratch resistance of the surface of the photoreceptor is deteriorated and therefore, the durability of the photoreceptor is insufficient. When the film thickness exceeds 10 μm, there is a fear that the resolution of the photoreceptor is lowered.

The image forming apparatus of the present invention is provided with the photoreceptor of the present invention, a charge means that electrifies the electrophotographic photoreceptor, an exposure means that exposes the charged electrophotographic photoreceptor to light to form an electrostatic latent image, a developing means that develops the electrostatic latent image formed by the exposure to visualize the image and a transfer means that transfers the image visualized by the developing to a recording medium.

The image forming apparatus of the present invention and its behavior will be explained with reference to the drawings, though the present invention is not limited by the following descriptions.

FIG. 4 is a schematic side view showing a structure of the image forming apparatus of the present invention.

An image forming apparatus (laser printer) 100 shown in FIG. 4 has a structure including a photoreceptor 1 of the present invention, an exposure means (semiconductor laser) 31, a charge means (charger) 32, a developing means (developing unit) 33, a transfer means (transfer charger) 34, a conveyer belt (not shown), a fixing means (fixing unit) 35 and a cleaning means (cleaner) 36. The reference numeral 51 represents a transfer paper.

The photoreceptor 1 is supported by the body (not shown) of the image forming apparatus 100 in a freely rotatable manner and rotated in the direction of the arrow 41 around a rotating axis 44 by a driving means (not shown). The driving means has a structure including, for example, a motor and a reduction gear and transfers its drive force to a conductive support constituting the core body of the photoreceptor 1 to thereby rotate the photoreceptor 1 at a specified peripheral speed. The charger 32, the exposure means 31, the developing means (developing unit) 33, the transfer charger 34 and the cleaning means (cleaner) 36 are arranged in this order from the upstream side toward the downstream side of the rotation direction of the photoreceptor 1 shown by the arrow 41 along the outer peripheral surface of the photoreceptor 1.

The charger 32 is an example of a charging means that uniformly electrifies the outer peripheral surface of the photoreceptor 1 to a given potential.

The exposure means 31 is provided with a semiconductor laser as its light source and applies light of a laser beam output from the light source to the surface of the laminate type photoreceptor 1 between the charger 32 and the developing unit 33 to thereby expose the outer peripheral surface of the charged photoreceptor 1 to light corresponding to image information. The photoreceptor 1 is scanned repeatedly with light in the direction in which the rotating axis 44 of the photoreceptor 1 is extended (which is the major scanning direction) and the scanned light form an image, thereby forming electrostatic latent images one after another on the surface of the photoreceptor 1. In other words, the parts of the photoreceptor 1 uniformly charged by the charger 32 are made to differ from each other in the quantities of charge depending on whether or not these parts are irradiated with the laser beam, to thereby form an electrostatic latent image.

The developing unit 33 is a developing means that develops the electrostatic latent image formed on the surface of the photoreceptor 1 by the exposure, by using a developer (toner). The developing unit 33 is disposed facing the photoreceptor 1 and provided with a developing roller 33*a* which supplies a toner to the outer peripheral surface of the photoreceptor 1 and a casing 33*b* which supports the developing roller 33*a* in a rotatable manner around the rotating axis parallel to the rotating axis 44 of the photoreceptor 1 and contains a toner in its inner space.

The transfer charger 34 is a transfer means which transfers the toner image which is a visual image formed on the outer peripheral surface of the photoreceptor 1 by the developing, to the surface of the transfer paper 51 that is a recording medium supplied between the photoreceptor 1 and the transfer charger 34 from the direction of the arrow 42 by a conveyer means (not shown). The transfer charger 34 is provided with, for example, a charge means and is a contact type transfer means which gives the transfer paper 51 charges having polarity reverse to that of the toner to transfer the toner image to the transfer paper 51.

The cleaner 36 is a cleaning means that removes and recovers the toner left on the outer peripheral surface of the photoreceptor 1 after the transfer operation of the transfer charger 34 is finished and is provided with a cleaning blade 36*a* that serves to peel off the toner left on the outer peripheral surface of the photoreceptor 1 and a recovery casing 36*b* that receives the toner peeled by the cleaning blade 36*a*. The cleaner 36 is disposed together with an erase lamp (not shown).

The image forming apparatus 100 is provided with the fixing unit 35 which is a fixing means that fixes the transferred image, on the downstream side to which the transfer paper 51 which has passed between the photoreceptor 1 and the transfer charger 34 is conveyed. The fixing unit 35 is provided with a heating roller 35*a* having a heating means (not shown) and a pressure roller 35*b* which is disposed opposite to the heating roller 35*a* and pressed by the heating roller 35*a* to form a contact part.

The reference numeral 37 represents a separating means that separates the transfer paper from the photoreceptor and the reference numeral 38 represents a casing that accommodates each units of the image forming apparatus.

The image forming operation of the electrophotographic apparatus 100 is carried out in the following manner.

First, when the photoreceptor 1 is rotated in the direction of the arrow 41 by a driving means, the surface of the photoreceptor 1 is uniformly charged to a predetermined positive potential by the charger 32 disposed on the upstream side of the image point of light of the exposure means 31 in the rotation direction of the photoreceptor 1.

Then, light corresponding to image information is applied to the surface of the photoreceptor 1 from the exposure means 31. On the photoreceptor 1, the surface charge of the part irradiated with light is removed, causing a difference in surface potential between the part irradiated with light and the part not irradiated with light to thereby form an electrostatic latent image.

A toner is supplied to the surface of the photoreceptor 1 on which the electrostatic latent image has been formed from the developing unit 33 disposed on the downstream side of the image point of light of the exposure means 31 in the rotation direction of the photoreceptor 1, to develop the electrostatic latent image, thereby forming a toner image.

The transfer paper 51 is fed between the photoreceptor 1 and the transfer charger 34 synchronously when the photoreceptor 1 is exposed to light. Charges having polarity reverse to that of the toner are imparted to the fed transfer paper 51 by the transfer charger 34 to transfer the toner image formed on the surface of the photoreceptor 1, to the surface of the transfer paper 51.

The transfer paper 51 to which the toner image is transferred is conveyed to the fixing unit 35 by a conveying means, and heated and pressed when it is passed through the contact part between the heating roller 35*a* and the pressure roller 35*b* of the fixing unit 35 to fix the toner image to the transfer paper 51, thereby forming a firm image. The transfer paper 51 on which an image is thus formed is discharged out of the electrophotographic apparatus 100 by the conveying means.

On the other hand, the toner left on the surface of the photoreceptor 1 even after the toner image is transferred, by the transfer charger 34 is peeled from the surface of the photoreceptor 1 by the cleaner 36 and recovered. The charge of the surface of the photoreceptor 1 from which the toner has been removed is removed by light from an erase lamp as necessary, with the result that the electrostatic latent image on the surface of the photoreceptor 1 disappears. Then, the photoreceptor 1 is further rotated and a series of operations starting from the charging operation is repeated to form images successively.

EXAMPLES

The present invention will be explained in more detail by way of production examples, examples and comparative examples, which are not intended to limit the present invention.

Production Example 1

A polyamide resin of the present invention was produced as will be explained below.

A higher unsaturated fatty acid methyl ester (400 g) containing 72% of methyl oleate, 18% of methyl linoleate and 10% of methyl hexadecanoate was used as a raw material and a dimerization reaction was carried out at 230° C. for 5 hours by using 17% of activated white earth as a catalyst. Next, an unreacted fatty acid methyl ester fraction and an isomerized fatty acid methyl ester fraction were removed from the resulting product by vacuum distillation (230° C./1 torr) and the residue was subjected to molecular distillation (230° C./0.1 torr) to give dimethyl dicarboxylate (200 g) as a distillate and trimethyl tricarboxylate (50 g) as a distillation residue.

Then, the obtained dimethyl dicarboxylate and trimethyl tricarboxylate were mixed at a ratio of 7/3 and 2% of a Ni catalyst was added to the mixture, which was then made to undergo a hydrogenating reaction under a hydrogen pressure of 30 kg/cm$^2$ at a reaction temperature of 200° C. for 15 hours and then treated according to a usual method to give dimethyl dicarboxylate (200 g) partly containing methyl tricarboxylate.

To a flask having an inner volume of 4 L was attached a stirrer, a temperature gauge, a nitrogen-introducing tube extended into a liquid and a cooling condenser. A solution (1 L) obtained by dissolving 1.0 carboxyl group equivalent (220 g) of dimethyl dicarboxylate (b) in methanol such that its concentration became 50% and a solution (1 L) obtained by dissolving 1.0 amino group equivalent (26 g) of piperazine (a) in methanol such that its concentration became 50% were mixed at room temperature with stirring (a:b=1.0:1.0).

Because the temperature of the solution rose by the mixing operation, the flask was cooled. Then, the pressure in the flask was reduced (10 mmHg) and then, a nitrogen gas was introduced to return the pressure to normal pressure and to keep the reaction system in a nitrogen atmosphere. Then, the temperature of the system was raised gradually to distil methanol off. After the distillation of methanol was stopped, the temperature of the solution was raised to 150° C. over 1 hour to remove water and alcohol. After almost all water and alcohol were removed, the reaction temperature was raised to 200° C. over 30 minutes to carry out a reaction under reduced pressure (10 mmHg) for 30 minutes. The reaction product was transferred from the flask without cooling with keeping the nitrogen atmosphere to an extruder, where it was pelletized to give 200 g of a polyamide resin.

Production Example 2

A polyamide resin (180 g) was obtained in the same manner as in Production Example 1 except that a compound obtained by methyl-esterifying commercially available HARIDIMER 200 (manufactured by Harima Chemicals, Inc.) (200 g) was used in place of dimethyl dicarboxylate used in Production Example 1 (a:b=1.0:1.0).

Production Example 3

A polyamide resin (190 g) was obtained in the same manner as in Production Example 1 except that a solution (1 L) obtained by methyl-esterifying commercially available EMPOL 1018 (manufactured by Cognis Corporation) (200 g) and dissolving 1.0 carboxyl group equivalent (220 g) of the esterified product in methanol such that its concentration became 25% and a solution (2 L) obtained by dissolving 1.0 amino group equivalent (26 g) of piperazine in methanol such that its concentration became 50% were used (a:b=2.0:0.5).

Example 1

A photoreceptor as shown in FIG. 2 was manufactured.

First, 4 parts by weight of titanium oxide particles (trade name: TS-043, manufactured by Showa Denko K.K., average primary particle diameter: 32 nm) which were surface-treated with silicon dioxide anhydride and 1 part by weight of the polyamide resin produced in Production Example 1 were added in a mixed solvent of methyl alcohol and tetrahydrofuran (1:1) in a solid content of 16% by weight and the mixture was dispersed by a paint shaker for 8 hours to prepare 4 Kg of an intermediate layer-forming coating solution.

The obtained intermediate layer-forming coating solution was filled in a coating vessel and an aluminum drum support 30 mm in diameter and 340 mm in length (treated by cutting processing (10-spot surface roughness Rz defined in JISB-0601: 0.80 μm) in advance, followed by surface-washing) was immersed in the coating solution, and was pulled up, followed by natural drying to form an intermediate layer having a film thickness of 1 μm.

Then, 1 part by weight of titanyl phthalocyanine having an X-ray diffraction spectrum showing a primary peak at a Bragg angle (2θ±0.2°) of 27.3° for 1.541 ÅX-ray of CuKα as a charge generating material and 1 part by weight of a butyral resin (trade name: #6000-C, manufactured by Denki Kagaku Kogyo Kabushiki Kaisha) as a binder resin were mixed in 98 parts by weight of methyl ethyl ketone, and the mixture was dispersed using a paint shaker for 8 hours to prepare 4 Kg of a charge generating layer-forming coating solution.

The obtained charge generating layer-forming coating solution was applied to the surface of the previously formed intermediate layer in the same manner as in the formation of the intermediate layer and naturally dried to form a charge generating layer having a film thickness of 0.4 μm.

Then, 100 parts by weight of a triphenylamine compound having the following structure as a charge transport material, 150 parts by weight of a polycarbonate resin (trade name: PCZ-400, manufactured by Mitsubishi Gas Chemical Company, Inc.) as a binder resin and 0.02 parts by weight of silicon oil were mixed and tetrahydrofuran was used as a solvent to prepare 4 Kg of a charge transport layer-forming coating solution having a solid content of 25% by weight.

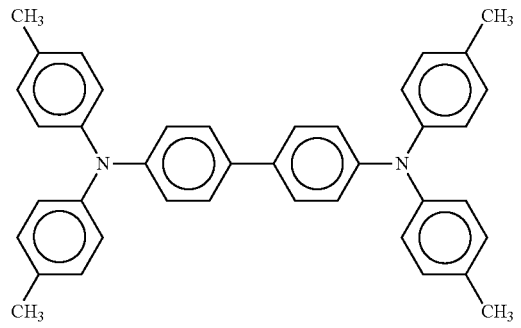

The obtained charge transport layer-forming coating solution was applied to the surface of the previously formed charge generating layer in the same manner as in the formation of the intermediate layer and dried at 130° C. for 1 hour to form a charge transport layer having a film thickness of 25 μm.

A photoreceptor shown in FIG. 2 was manufactured in this manner.

Example 2

A photoreceptor as shown in FIG. 2 was manufactured in the same manner as in Example 1 except that the polyamide resin produced in Production Example 2 was used in place of the polyamide resin produced in Production Example 1 in the preparation of the intermediate layer-forming coating solution.

Example 3

A photoreceptor as shown in FIG. 2 was manufactured in the same manner as in Example 1 except that the polyamide resin produced in Production Example 3 was used in place of the polyamide resin produced in Production Example 1 in the preparation of the intermediate layer-forming coating solution.

Example 4

A photoreceptor as shown in FIG. 2 was manufactured in the same manner as in Example 1 except that titanium oxide used in the preparation of the intermediate layer-forming coating solution was changed to 4 parts by weight of titanium oxide particles having a large particle diameter (trade name: TS-01, manufactured by Showa Denko K.K., average primary particle diameter: 110 nm).

Example 5

First, 0.5 parts by weight of methyl hydrogen polysiloxane (trade name: KF-99, manufactured by Shin-Etsu Chemical Co., Ltd.) as a surface treating agent and 50 parts by weight of toluene as a solvent were mixed in 10 parts by weight of zinc oxide (trade name: ZS-032, manufactured by Showa Denko K.K., average primary particle diameter: 31 nm) to prepare a suspension solution, which was further subjected to dispersing treatment using a paint shaker and zirconia beads having a diameter of 0.5 mm as the dispersing medium. The suspension solution after the treatment was distilled under reduced pressure to remove the solvent to give surface-coated zinc oxide particles. The obtained zinc oxide particles were heat-treated at 140° C. for 1 hour to manufacture zinc oxide particles which were surface-treated with methyl hydrogen polysiloxane.

Then, 4 parts by weight of the surface-treated zinc oxide particles and 1 part by weight of the polyamide resin produced in Production Example 1 were added in methyl alcohol such that the solid concentration was 16% by weight and the mixture was dispersed using a paint shaker for 8 hours to prepare 4 Kg of an intermediate layer-forming coating solution.

A photoreceptor as shown in FIG. 2 was manufactured in the same manner as in Example 1 except that this intermediate layer-forming coating solution was used.

Example 6

A photoreceptor as shown in FIG. 2 was manufactured in the same manner as in Example 1 except that 2 parts by weight of titanium oxide particles (trade name: TS-043, manufactured by Showa Denko K.K., average primary particle diameter: 32 nm) which were surface-treated with silicon dioxide anhydride and used in Example 1 and 2 parts by weight of titanium oxide particles (trade name: MT-500SA, manufactured by TAYKA CORPORATION, average primary particle diameter: 35 nm) treated with $Al_2O_3$ and $SiO_2.nH_2O$ were used in the preparation of the intermediate layer-forming coating solution.

Example 7

A photoreceptor as shown in FIG. 2 was manufactured in the same manner as in Example 6 except that a commercially available polyamide resin (trade name: M1276, manufactured by ARKEMA) was used in place of the polyamide resin produced in Production Example 1 in the preparation of the intermediate layer-forming coating solution.

Comparative Example 1

A photoreceptor as shown in FIG. 2 was manufactured in the same manner as in Example 1 except that a commercially available polyamide resin (trade name: Amilan CM8000, manufactured by Toray Industries, Inc.) which is a quarternary copolymer nylon was used as the polyamide resin in the preparation of the intermediate layer-forming coating solution.

Comparative Example 2

A photoreceptor as shown in FIG. 2 was manufactured in the same manner as in Example 1 except that a commercially available polyamide resin (trade name: VESTAMELT X1010, manufactured by Daicel-Evonik Ltd.) was used as the polyamide resin in the preparation of the intermediate layer-forming coating solution.

Comparative Example 3

A photoreceptor as shown in FIG. 2 was manufactured in the same manner as in Example 1 except that a commercially available polyamide resin (trade name: PA-105A, manufactured by FUJI KASEI KOGYO) was used as the polyamide resin in the preparation of the intermediate layer-forming coating solution.

Comparative Example 4

A photoreceptor as shown in FIG. 2 was manufactured in the same manner as in Example 1 except that the polyamide resin produced in Production Example 1 was used as the polyamide resin and an intermediate layer-forming coating solution in which a polyamide resin not containing titanium oxide particles is dissolved was used in the preparation of the intermediate layer-forming coating solution.

Comparative Example 5

A photoreceptor as shown in FIG. 2 was manufactured in the same manner as in Example 1 except that a polyamide resin (Japanese Patent No. 2852432) obtained by copolymerizing a monomer composition containing 6-aminocaproic acid, adipic acid and N-(β-aminoethyl)piperazine at a ratio of 1:1:1 was used.

The electric characteristics of the photoreceptors produced in Examples 1 to 7 and Comparative Examples 1 to 5 as mentioned above were evaluated.

The dispersibility of the intermediate layer-forming coating solutions used in the production of the photoreceptors was also evaluated.

<Electric Characteristics>

Each of the photoreceptors manufactured in Examples 1 to 7 and Comparative Examples 1 to 5 as mentioned above was mounted on a commercially available digital copying machine (trade name: AR-450S, manufactured by Sharp Corporation) equipped with a corona discharger/charger as a charge means for the photoreceptor, the developing unit was dismounted from this digital copying machine and a surface potentiometer (trade name: model 344, manufactured by TREK Japan K.K.) was mounted on the developing position instead to be able to measure the surface potential of the photoreceptor during the course of image formation, thereby remodeling the copying machine into an evaluating machine for evaluating initial electric characteristics and electric durability.

Incidentally, the digital copying machine (trade name: AR-450S, manufactured by Sharp Corporation) before remodeling is a negatively charged image forming apparatus which forms an image in a reverse developing process by negatively charging the surface of the photoreceptor.

The evaluating machine was used in a normal temperature/normal humidity (N/N) environment of a temperature of 50° C. and a relative humidity of 50% to measure the surface potential of the photoreceptor unexposed to laser light as a charge potential Vo (V) and the surface potential of the photoreceptor exposed to laser light as an exposed potential VL (V). The results of the measurement were taken as an index of evaluation of the initial electric characteristics. With regard to the initial electric characteristics of each photoreceptor, the larger the absolute value of the charge potential Vo (V) was, the more excellent the electrification characteristics were, and the smaller the absolute value of the exposure potential VL was, the higher the response ability was.

Then, the surface potentiometer was dismounted from the evaluating machine and the developing unit was mounted again on the copying machine. Using this copying machine, a test image having a prescribed pattern was formed on 100,000 recording sheets. After the formation of 100,000 copies of images by the copying machine was completed, the developing unit was again dismounted. Then, the surface potentiometer was mounted on the evaluating position on the evaluating machine and the charge potential Vo (V) and the exposure potential VL (V) were measured in the same manner as in the initial stage.

The same evaluation was carried out in a low-temperature/low-humidity (L/L) environment of a temperature 5° C. and a relative humidity of 20% and in a high-temperature/high-humidity (H/H) environment of a temperature of 35° C. and a relative humidity of 80%.

The smaller the potential variation ΔVL was, the higher the stability of electric characteristics were evaluated.

The electric characteristics were evaluated according to the following criteria.

In all the environments:

G (good): good ΔVL, less than 60 V in all the environments and use.

NB (not bad): somewhat poor ΔVL, 60 V or more and less than 80 V in any one of the environments.

B (bad): poor ΔVL, 80 V or more in any one of the environments.

<Image Evaluation>

The image after completion of the repeated image formation was evaluated.

G (good): good

NB (not bad): although there is no practical problem, fine black dots exist.

B (bad): many fine black dots exist.

VB (very bad): fogging is generated

<Ozone Resistance>

After an image was repeatedly formed in an environment of a room temperature of 5° C. and a relative humidity of 20% to evaluate the electric characteristics and images, test images were formed on 1,000 sheets. Then, the power source of the copying machine was turned off and the copying machine was allowed to stand for 8 hours. Then, a black solid image was formed and the image was evaluated.

G (good): good black solid image free from white voids.

NB (not bad): slight white voids appear on a black solid image though they pose practically no problem.

B (bad): white voids appear on a black solid image.

<Coating Ability>

The intermediate layer-forming coating solution was applied to a PET sheet on which aluminum was deposited, by using an applicator in an environment of a room temperature of 25° C. and a relative humidity of 50%, and naturally dried to manufacture a coating film including only an intermediate layer 1 μm in thickness. Then, the intermediate layer was visually observed whether or not any turbidity was present.

G (good): good

B (bad): turbid

The obtained results are shown in Tables 1 and 2.

TABLE 1

| | | N/N | | | H/H | | | L/L | | | Maximum | Evaluation of |
|---|---|---|---|---|---|---|---|---|---|---|---|---|
| | | Initial stage | After use | Variation | Initial stage | After use | Variation | Initial stage | After use | Variation | potential difference | electric characteristics |
| Example 1 | VO | −650 | −645 | −5 | −655 | −635 | −20 | −645 | −635 | −10 | 20 | G |
| | VL | −120 | −135 | 15 | −110 | −145 | 35 | −130 | −135 | 5 | 35 | |
| Example 2 | VO | −650 | −645 | −5 | −655 | −635 | −20 | −645 | −635 | −10 | 20 | G |
| | VL | −120 | −135 | 15 | −110 | −145 | 35 | −130 | −135 | 5 | 35 | |
| Example 3 | VO | −650 | −645 | −5 | −655 | −635 | −20 | −645 | −635 | −10 | 20 | G |
| | VL | −120 | −135 | 15 | −110 | −145 | 35 | −130 | −135 | 5 | 35 | |
| Example 4 | VO | −650 | −645 | −5 | −655 | −635 | −20 | −645 | −635 | −10 | 20 | G |
| | VL | −120 | −135 | 15 | −110 | −145 | 35 | −130 | −135 | 5 | 35 | |
| Example 5 | VO | −650 | −645 | −5 | −655 | −595 | −60 | −645 | −635 | −10 | 60 | NB |
| | VL | −120 | −135 | 15 | −110 | −150 | 40 | −130 | −140 | 10 | 40 | |
| Example 6 | VO | −650 | −640 | −10 | −655 | −620 | −35 | −645 | −630 | −15 | 35 | G |
| | VL | −120 | −140 | 20 | −110 | −155 | 45 | −140 | −150 | 10 | 45 | |
| Example 7 | VO | −650 | −640 | −10 | −655 | −620 | −35 | −645 | −630 | −15 | 35 | G |
| | VL | −120 | −130 | 10 | −110 | −150 | 40 | −140 | −155 | 15 | 45 | |
| Comparative | VO | −650 | −635 | −15 | −640 | −600 | −40 | −640 | −655 | 15 | 55 | B |
| Example 1 | VL | −120 | −115 | −5 | −105 | −70 | −35 | −165 | −185 | 20 | 115 | |
| Comparative | VO | −650 | −635 | −15 | −655 | −615 | −40 | −645 | −635 | −10 | 40 | B |
| Example 2 | VL | −120 | −155 | 35 | −110 | −185 | 75 | −155 | −190 | 35 | 80 | |
| Comparative | VO | −650 | −635 | −15 | −655 | −615 | −40 | −645 | −620 | −25 | 40 | B |
| Example 3 | VL | −120 | −140 | 20 | −110 | −175 | 65 | −155 | −195 | 40 | 85 | |
| Comparative | VO | −650 | −645 | −5 | −655 | −615 | −40 | −645 | −535 | −10 | 40 | B |
| Example 4 | VL | −120 | −145 | 25 | −110 | −150 | 40 | −150 | −190 | 40 | 80 | |

TABLE 1-continued

| | | N/N | | | H/H | | | L/L | | | Maximum | Evaluation of |
|---|---|---|---|---|---|---|---|---|---|---|---|---|
| | | Initial stage | After use | Variation | Initial stage | After use | Variation | Initial stage | After use | Variation | potential difference | electric characteristics |
| Comparative | VO | −650 | −630 | −20 | −655 | −615 | −40 | −645 | −620 | −25 | 40 | B |
| Example 5 | VL | −120 | −160 | 40 | −110 | −155 | 45 | −150 | −195 | 45 | 85 | |

TABLE 2

| | image evaluation | | | Ozone | Evaluation of coating |
|---|---|---|---|---|---|
| | N/N | H/H | L/L | resistance | ability |
| Example 1 | G | G | G | G | G |
| Example 2 | G | G | G | G | G |
| Example 3 | G | G | G | G | G |
| Example 4 | G | G | G | G | G |
| Example 5 | G | G | G | G | G |
| Example 6 | G | NB | G | G | G |
| Example 7 | G | G | G | G | G |
| Comparative Example 1 | NB | VB | G | G | G |
| Comparative Example 2 | G | B | B | B | G |
| Comparative Example 3 | G | B | B | B | B |
| Comparative Example 4 | G | B | B | B | G |
| Comparative Example 5 | G | B | B | B | B |

From the results of the evaluation shown in Table 1, the following fact was found.

It was found that each photoreceptor obtained in Examples 1 to 7 using the polyamide resin of the present invention was reduced in potential variation when it was repeatedly used in any environment as compared with each photoreceptor obtained in Comparative Examples 1 to 5 using a conventional polyamide resin and attained always stable electric characteristics.

Example 5 had a tendency that the charge potential drops by repeated use.

In the case where neither the aliphatic carboxylic acid structure nor the diamine structure having a piperazine ring structure existed (Comparative Example 1), a rise in VL was brought about due to an increase in volume resistance of the intermediate layer in a low-temperature and low-humidity environment because the hygroscopic ability of the polyamide resin was high. The volume resistance of the intermediate layer dropped by moisture absorption in a high-temperature/high-humidity environment, resulting in a lower VL, showing a large adverse influence on electric characteristics.

In the case where the aliphatic carboxylic acid structure did not exist but the alicyclic diamine structure existed (Comparative Example 2), in the case where the aliphatic carboxylic acid structure existed but the piperazine ring structure did not exist (Comparative Example 3) and in the case where the piperazine ring structure existed but aliphatic amino carboxylic acid was contained in a large amount and therefore there was a difference in the ratio of monomer components (Comparative Example 5), the electric resistance of the resin itself increased, resulting in impaired sensitivity in general.

Moreover, when the metal oxide microparticles were not contained (Comparative Example 4), the volume resistance of the intermediate layer rose, bringing about deteriorated sensitivity.

It was found from the aforementioned results that the photoreceptor of the present invention is reduced in the variation in sensitivity in a low-temperature/low-humidity environment to a high-temperature/high-humidity environment, making it possible to attain good electric characteristics.

The following fact was found from the results of evaluation as shown in Table 2.

Specifically, it was found that each photoreceptor (Examples 1 to 7) using the polyamide resin of the present invention is excellent in image characteristics in any environment as compared with the photoreceptors (Comparative Examples 1 to 3, and 5) using conventional polyamide resins and the photoreceptor (Comparative Example 4) which does not contain the metal oxide microparticles.

It is to be noted that some fine black dots were observed in the photoreceptor of Example 6 though they have no practical problem.

In the case where neither the aliphatic carboxylic acid structure nor the diamine structure having a piperazine ring structure existed (Comparative Example 1), many fine black dots were generated in a low-temperature/low-humidity environment and fogging of an image was generated in a high-temperature/high-humidity environment.

In the case where the aliphatic carboxylic acid structure did not exist but the alicyclic diamine structure existed (Comparative Example 2), in the case where the aliphatic carboxylic acid structure existed but the piperazine ring structure did not exist (Comparative Example 3) and in the case where the piperazine ring structure existed but aliphatic amino carboxylic acid was contained in a large amount and therefore there was a difference in the ratio of monomer components (Comparative Example 5), fogging of an image was generated in a low-temperature/low-humidity environment and in a high-temperature/high-humidity environment.

It was found from the aforementioned results that the photoreceptor of the present invention exhibits excellent image characteristics in all environments including a low-temperature/low-humidity environment and a high-temperature/high-humidity environment.

From the aforementioned results, it was found that as to the image characteristics of the photoreceptors (Examples 1 to 7) using the polyamide resin according to the present invention, each photoreceptor was excellent in ozone resistance as compared with the photoreceptors (Comparative Examples 1 to 5) using a conventional polyamide resin.

In Comparative Examples 1 to 5, the sensitivity was deteriorated by ozone and nitrogen oxide generated inside the copying machine, resulting in the generation of white voids in a black solid image.

From the aforementioned results, it was found that the photoreceptor of the present invention is excellent in ozone resistance.

It was found that each photoreceptor (Examples 1 to 7) using the polyamide resin of the present invention was reduced in hygroscopic ability and was free from the generation of aggregation of metal oxide particles, exhibiting excellent coating ability.

In Comparative Examples 1, 3 and 5, the coating film had turbidity in cases where it had high hygroscopic ability or the metal oxide particles were easily aggregated because of the vaporization of a solvent when the coating film was formed.

It was found from the aforementioned results that the photoreceptor of the present invention has excellent coating ability.

According to the present invention, a photoreceptor can be provided which is reduced in the variation in sensitivity and can attain good image characteristics in all environments including a low-temperature/low-humidity environment and a high-temperature/high-humidity environment.

The coating solution used in forming the intermediate layer of the photoreceptor of the present invention can maintain a desired dispersion condition for a long time and can form a coating film free from coating unevenness even after long-term storage.

What is claimed is:

1. An electrophotographic photoreceptor comprising:

a conductive support, a photosensitive layer and an intermediate layer interposed between the conductive support and the photosensitive layer, wherein the intermediate layer contains metal oxide microparticles surface-treated with silicon dioxide anhydride and a binder resin; and the binder resin contains a polyamide resin containing a piperazine-based compound.

2. The electrophotographic photoreceptor according to claim 1, wherein the intermediate layer contains metal oxide microparticles surface-treated with silicon dioxide anhydride and a binder resin; and the binder resin contains a polyamide resin which is a condensate of a piperazine-based compound and an aliphatic di- or tri-carboxylic acid compound or a lower alkyl ester thereof or a mixture of these.

3. The electrophotographic photoreceptor according to claim 1, wherein the binder resin contains a condensate of the piperazine-based compound and a linear aliphatic dicarboxylic acid, or a branched di- or tri-carboxylic acid produced as the aliphatic di- or tri-carboxylic acid by a bimolecular or termolecular addition reaction to unsaturated bonds of one or a mixture of two kinds of monounsaturated fatty acids and diunsaturated fatty acids or esters thereof.

4. The electrophotographic photoreceptor according to claim 1, wherein the binder resin contains a condensate of piperazine and oleic acid, linoleic acid, or lower alkyl esters thereof or bimolecular or termolecular addition reaction products to unsaturated bonds of mixtures of these.

5. The electrophotographic photoreceptor according to claim 1, wherein the binder resin is a condensate of (a) a piperazine-based compound and (b) the aliphatic di- or tri-carboxylic acid compound or a lower alkyl ester thereof or a mixture of these in which the equivalent ratio of (a):(b)=1.0 to 2.0:0.5 to 1.0.

6. The electrophotographic photoreceptor according to claim 1, wherein the binder resin contains a polyamide resin having a number average molecular weight of 5,000 to 80,000.

7. The electrophotographic photoreceptor according to claim 1, wherein the metal oxide microparticles are titanium oxide microparticles.

8. The electrophotographic photoreceptor according to claim 1, wherein the metal oxide microparticles are titanium oxide microparticles having a number average primary particle diameter of 30 to 50 nm.

9. The electrophotographic photoreceptor according to claim 1, wherein the metal oxide microparticles are contained in a ratio of 50 to 1000 parts by weight based on 100 parts by weight of the polyamide resin.

10. The electrophotographic photoreceptor according to claim 1, wherein the photosensitive layer is a laminate type photosensitive layer formed of a charge generating layer containing a charge generating material and a charge transport layer containing a charge transport material.

11. An image forming apparatus comprising the electrophotographic photoreceptor as claimed in claim 1, a charge means that electrifies the electrophotographic photoreceptor, an exposure means that forms an electrostatic latent image by exposing the charged electrophotographic photoreceptor to light, a developing means that develops the electrostatic latent image formed by the exposure means to visualize the image and a transfer means that transfers the image visualized by the developing means, to a recording medium.

* * * * *